United States Patent [19]

Ignoffo

[11] 4,338,284

[45] Jul. 6, 1982

[54] EXHAUST GAS PURIFIER

[75] Inventor: Vincent E. Ignoffo, Chicago, Ill.

[73] Assignee: Vinco Sales Corp., Inc., Chicago, Ill.

[21] Appl. No.: 71,857

[22] Filed: Sep. 4, 1979

[51] Int. Cl.[3] ..... F01N 3/28; F01N 7/00

[52] U.S. Cl. ..... 422/171; 55/DIG. 30; 422/176

[58] Field of Search ..... 422/170, 171, 176, 177; 60/299; 181/231, 248, 249, 252; 55/276, 316, DIG. 30

[56] References Cited

U.S. PATENT DOCUMENTS

| | | | |
|---|---|---|---|
| 3,247,665 | 4/1966 | Behrens | 60/299 |
| 3,485,593 | 12/1969 | Lenane et al. | 55/DIG. 30 |
| 3,511,617 | 5/1970 | Lyben | 181/249 |
| 3,522,863 | 8/1970 | Ignoffo | 181/252 |
| 3,754,619 | 8/1973 | McCormick | 55/276 |
| 4,032,310 | 6/1977 | Ignoffo | 55/DIG. 30 |

*Primary Examiner*—Bradley Garris
*Attorney, Agent, or Firm*—Matthew C. Thompson

[57] ABSTRACT

Automotive gas purifiers having a tubular core for conveying hot exhaust gases from an entrant opening to an exit opening in a hollow casing which surrounds the core, a plurality of transversely louvered openings in said tubular core and providing a plurality of small passages in said core means for passage of exhaust gases into and out of the annular space, a transverse wall dividing said annular space into an upstream segment and a downstream segment, a body of small catalyst particles for purifying said hot exhaust gases in said annular space of said upstream segment and surrounding said passages within said upstream segment, wrappings of fiberglass substantially filling the downstream segment of said annular space, said tubular core being a one-piece tube or a two-piece tube in which tubular core is divided into an upstream part extending from the gas entrant end of said casing to one side of said transverse wall and a downstream part extending from the opposite side of said transverse wall to the gas exit end of said casing, said upstream and downstream parts being divided by a part of said transverse wall, which part has a plurality of small passages for passage of part of the exhaust gases through from said upstream part directly into said downstream part, and said transverse wall having a plurality of small apertures therein and through which said exhaust gases can flow from said annular space of said upstream segment to the downstream segment.

11 Claims, 6 Drawing Figures

EXHAUST GAS PURIFIER

INTRODUCTION

The subject invention pertains to automotive exhaust gas purifiers which are mounted in the exhaust systems of automobiles and other automotive vehicles driven by an internal combustion engine. The exhaust gases are caused to pass through a body of small catalyst particles which cause the hydrocarbon content of the exhaust gas to convert to carbon dioxide and water. The catalyst particles can also have the properties of converting toxic gases such as nitrous oxide, carbon monoxide, and others into non-toxic or less toxic gases, e.g., conversion of carbon monoxide to carbon dioxide. An active catalytic component of said catalyst particles is palladium, which may be the sole catalytic component, or may be used in combination with other catalytic components such as platinum.

All new automotive vehicles made in the United States have a catalytic converter in the exhaust gas system of the internal combustion engine. These catalytic converters use palladium catalyst particles, alone or in mixture, with platinum catalyst particles. It is possible to also provide the palladium and platinum on each catalyst particle. The catalytic converters used as original equipment generally constitute a hollow casing in which is contained a body of the catalyst particles through which all of the exhaust gases flow.

The subject automotive exhaust gas purifiers may be used as original equipment or as replacements. Tests run with the subject purifiers in the exhaust gas system of automobiles have shown that the subject purifiers perform excellently in the conversion of hydrocarbons in the exhaust gas—reducing the hydrocarbon emission of the exhaust gases to values which are a small fraction of the current maximum allowable hydrocarbon content called for in federal specifications.

PRIOR ART

There are many known types of exhaust gas purifiers which are marketed or used as original equipment and/or as replacement, after market equipment. The exhaust gas purifiers of this invention utilize some of the structural components of the glass-packed muffler disclosed in my U.S. Pat. No. 3,522,863, issued Aug. 4, 1970. Also, the exhaust gas purifiers of the subject invention in which the casing is split into two separable components embody a downstream segment having an annular space between the casing and the tubular core which is substantially filled with fiberglass, as is disclosed in my U.S. Pat. No. 4,032,310, issued June 28, 1977.

BRIEF DESCRIPTION OF THE INVENTION

This invention in general pertains to automotive exhaust gas purifiers which have a tubular core which is one piece or is split into two pieces, i.e., an upstream part and a downstream part. The tubular core is connected on its opposite longitudinal ends to an entrant opening and an exit opening in the respective longitudinal ends of the casing which surrounds the tubular core. The casing defines the inner side of an annular space between the tubular core and the casing.

Both the upstream and the downstream parts of the tubular core have a plurality of small passages for passage of exhaust gases into and out of the annular space. These small passages preferably are louvered openings in the tubular core formed by slitting the core transversely and shaping the metal on one side of each slit into a louver extending diagonally rearwardly toward the upstream end of the purifier, and inwardly into the tubular core, whereby the openings face the upstream end of the core. These louvered openings preferably are arranged in a plurality of longitudinal columns on the tubular core.

A transverse wall divides the annular space between the core and the casing into an upstream segment and a downstream segment. Both the upstream and downstream parts of the tubular core have the aforesaid small passages. The transverse wall has a plurality of small apertures therein, which apertures connect the upstream and downstream parts of the annular space and allow the exhaust gases to pass from the upstream annular space into the downstream annular space. In some embodiments most of the upstream annular space is filled with a body of small catalyst particles having a catalyst which purifies the hot exhaust gases, e.g., by converting hydrocarbons in the exhaust gas to carbon dioxide and water. Most of the exhaust gases flowing through the upstream part of the tubular core pass through the small passages into the surrounding body of small catalyst particles, and then through the small apertures in the transverse wall into the downstream segment of the annular space, which preferably is substantially filled with fiberglass. Such gases then pass from the downstream segment of the annular space through the small passages in the downstream part of the tubular core and then out the exit end of the casing.

The center portion of the transverse wall preferably also has small passages therethrough which connect the upstream part with the downstream part of the tubular core. A relatively small fraction of the exhaust gases pass directly from the upstream part of the core into the downstream part. The small passages of the center portion of the transverse wall are provided mainly to relieve what would otherwise be excessive back pressure of the exhaust gases caused by resistance to gas flow built up in the exhaust gas purifier for relatively high horse power internal combustion engines having a relatively high volume rate of flow of exhaust gases. It is sometimes advisable to provide a larger, preferably centrally positioned circular gas passage in the transverse wall with a diameter on the order of $\frac{1}{4}''$ to $\frac{3}{4}''$. The size of this gas passage is substantially larger than the size of the individual sizes of the small passages in the transverse wall, which are on the order of 1/32" up to $\frac{1}{8}''$.

In some embodiments of the invention the casing is divided into an upstream section and a downstream section which are releasably coupled together, e.g., by opposed flanges on the respective sections which are clamped together by any suitable clamping or holding means, e.g., bolts. A removable cartridge filled with small catalyst particles is seated in the upstream section of the casing about the upstream part of the tubular core in the annular space between the upstream part of the tubular core and the upstream section of the casing. The cartridge has annular inner and outer walls and two end walls between the respective upstream and downstream ends of the annular inner and outer walls of the cartridge. The annular inner wall of the cartridge is permeable to the flow of exhaust gases from the small passages in the upstream part of the tubular core into the body of small catalyst particles in the cartridge. The downstream end wall of the cartridge also is a perforate wall permeable to the flow of exhaust gases out of the cartridge. With the cartridge, all of, or only the annular portion of, the transverse wall may be omitted.

The tubular core preferably is divided into an upstream part inside the upstream section of the casing and a downstream part inside the downstream section of the casing. When the upstream section of the two-piece, divided casing is filled substantially with a loose body of catalyst particles (not in a cartridge), the perforate transverse wall is used. The transverse wall, when present, is preferably fixedly attached to the upstream end or portion of the downstream part of the tubular core. As in the eariler embodiments, the annular space between the downstream section of the casing and the downstream part of the tubular core preferably is substantially filled with fiberglass.

PREFERRED EMBODIMENTS

The preferred embodiments of the invention are illustrated in the drawings, wherein:

IN THE DRAWINGS

Figure 1:
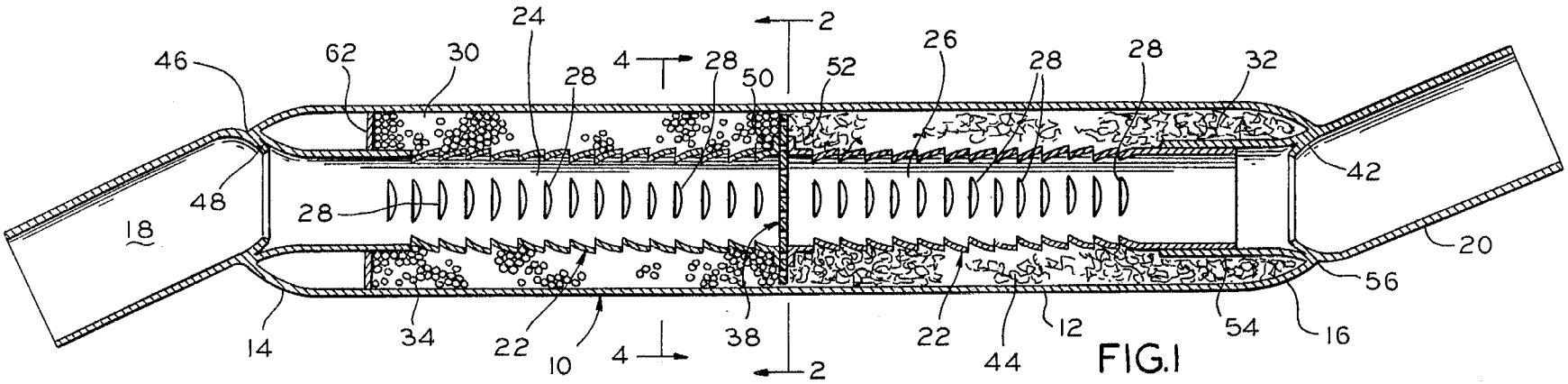
FIG. 1 is a diagramatic section of a first embodiment of the subject automotive exhaust gas purifier.

Referring to the drawings, the first embodiment of the invention is an exhaust gas purifier 10 having a one-piece tubular casing 12. The casing 12 has a domed upstream end 14 and a domed downstream end 16 to which are respectively welded the exhaust gas entrant tube 18 and the exhaust gas exit tube 20. A tubular core 22 extends longitudinally and radially centrally from end to end of the casing 12. The tubular core is composed of an upstream part 24 and a downstream part 26. Each part 24 and 26 has a plurality of transverse louvered openings 28 arranged in a plurality of longitudinal columns (4 columns in the case of FIG. 1). These louvered openings constitute small passages for the passage of exhaust gas between respective parts of the tubular core 22 and the annular spaces 30 and 32 between the tubular core parts 24 and 26 and the inside wall of the casing 12. The louvers 30 extend diagonally toward the upstream end of the purifier and inwardly toward the longitudinal center of the tubular core 22.

The upstream annular space 30 is substantially filled with small particles 34 of a solid catalyst which will convert exhaust gas components such as hydrocarbons to less toxic or less noxious gaseous compounds by reaction thereof with oxygen which is present in the exhaust gases, i.e., the oxygen content of excess air not consumed in the internal combustion of gasoline, diesel oil, etc.

The upstream part 24 and the downstream part 26 of the annular space are divided by the peripheral portions 36 of the transverse, divider wall 38. The peripheral portions 36 of the transverse wall 38 have a relatively large number of small passages 40 extending through the wall. These passages allow the major portion of the exhaust gases flowing through the purifier to pass from the catalyst-containing upstream part 24 of the annular space into the downstream part 26 of the annular space. Such gases exit from the annular part 26 through the louvered openings 28 in the downstream part 26 of the tubular core, from which the gases exit from the downstream end 42 into the gas exit tube 20. Preferably, though not essentially, the downstream annular space 32 is substantially filled with fiberglass 44 wrapped in superposed layers about the part 26 of the tubular core.

The upstream end 46 of the upstream part 24 of the tubular core is welded to the periphery of the upstream opening 48 of the casing 12.

The downstream end of the upstream part 24 of the tubular core has a ring flange or a flare 50 which actually or substantially abuts against the upstream face of the transverse wall 38. Similarly, the upstream end of the downstream part 26 of the tubular core has a ring flange or flare 52 which is tack-welded or spot-welded to the downstream face of the transverse wall 38. The periphery of the transverse wall need not be welded or otherwise affixed to the inner side of the casing 12. The downstream end of the downstream part 26 of the tubular core is slidably seated into a ring sleeve 54, the downstream end 56 of which is welded to the periphery of the downstream opening 42 of the casing 12. This slip connection allows the tubular core to expand and contract without strain being placed on the walls of the tubular core. The center portion 58 of the transverse wall, i.e., that portion corresponding to the cross-sectional area of the tubular core 22, preferably also has a plurality of small gas passages 60 extending therethrough. These passages, as well as the small passages 40, have diameters in the order of about 1/32" to about $\frac{1}{8}$".

The louvered openings 28 are spaced a significant distance from the respective ends of the tubular core sections 24,26 which are welded in the openings 46,42 of the casing 12 in order that these portions of the core have sufficient strength to be welded successfully. Therefore, there is no louvered opening 28 within most of or all of the domed upstream end of the casing 12. Since this is dead area in terms of exhaust air flow, a transverse, ring wall 62 may be inserted in the casing about the part 24 of the tubular core 22 to block off the dead area, and thus save on volume of catalyst particles needed to fill the upstream annular space 30. The ring wall may be welded to the tubular core part 24 and/or the casing 12.

Thus, it will be seen that exhaust gases enter the gas entrant tube 18 and flow into the upstream part 24 of the tubular core 22. Most of the exhaust gases pass through the louvered openings 28 into and through the body of catalyst particles 34 in the annular space 30. A minor fraction of the exhaust gases pass directly through the small passages 60 in the center portion of the transverse wall 38.

The bulk of the exhaust gases exit from the body of catatyst particles 34 through the small passages 40 in the periphery of transverse wall 38. Such gases then pass through the fiberglass 44 and out of the louvered openings 28 in the downstream part 26 of the tubular core 22.

They then flow through the tubular core part 26 and exit through the gas exit tube 20.

Figure 3:
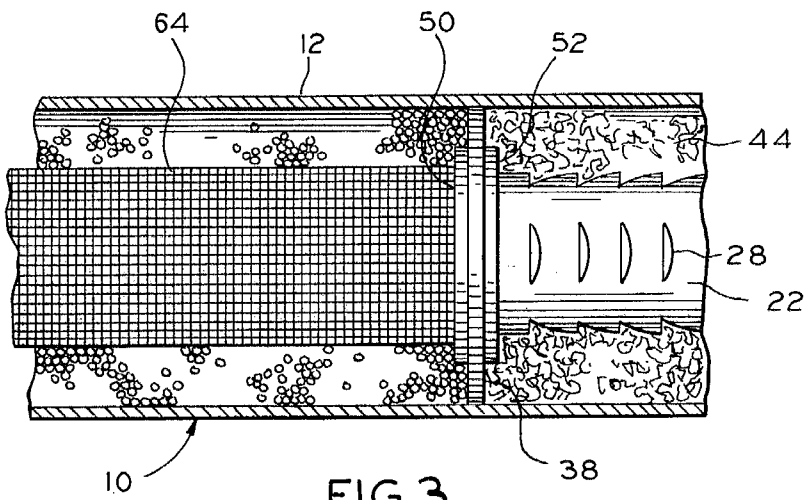
FIG. 3 is a fragmentary diametric section of a second embodiment of the invention.
Figure 2:
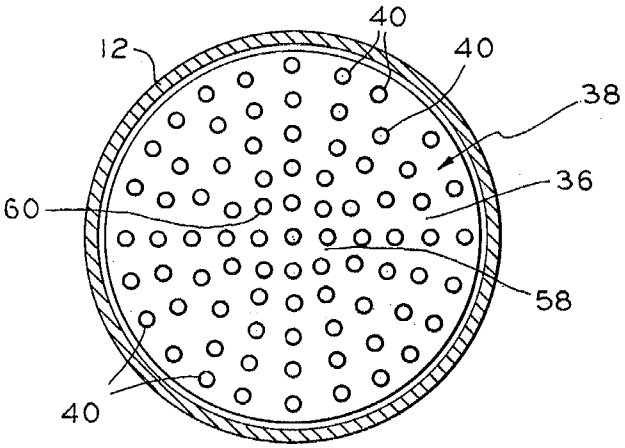
FIG. 2 is a transverse section view of the embodiment of FIG. 1 taken on section plane 2—2 of FIG. 1.

The embodiment of FIG. 3 is similar in most respects to the embodiment of FIGS. 1 and 2, and like numerals are used to designate like parts. The embodiment of FIG. 3 differs only in that the upstream part 24 of the tubular core 22 is wrapped with a relatively fine screen 64 which allows the gases to pass through the louvered openings 28, but constrains the catalyst particles from being lost through the louvered openings 28. Such screening is used where the desired size of the louvered openings is approximately equal to or larger than the diameter of the smallest particles 34 of the catalyst, which small particles usually are either spheres or small cylinders, i.e., a pelletized cylindrical rod, but also may be a honeycomb body or bodies.

Figure 4:
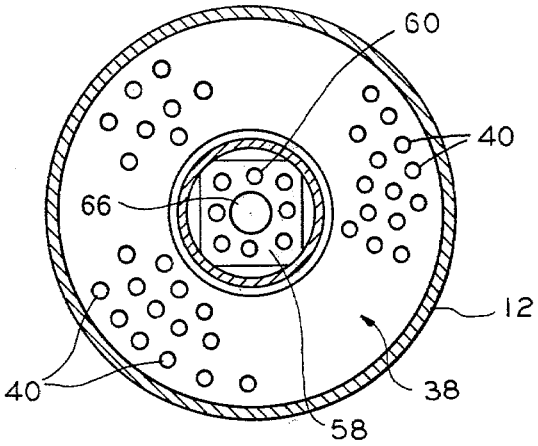
FIG. 4 is a transverse section of a third embodiment similar in most respects to the embodiment of FIG. 1, as the third embodiment would be viewed from second plane 4—4 of FIG. 1.

The embodiment of FIG. 4 is also similar in most respects to the embodiment of FIG. 1 as well as to that of FIG. 3. The chief difference in the embodiment of FIG. 4 is that the center portion 58 of the transverse wall 38 has a gas passage 66 of significantly larger diameter or cross-sectional area than the diameters or cross-sectional area of the individual small passages 60. The larger gas passage 66 is used in exhaust systems of internal combustion engines having relatively high horse power and consequently relatively high volumes of exhaust gases. The larger gas passage 66 relieves what would otherwise be excessive back pressure caused by the exhaust gas purifier of the invention.

Figure 5:
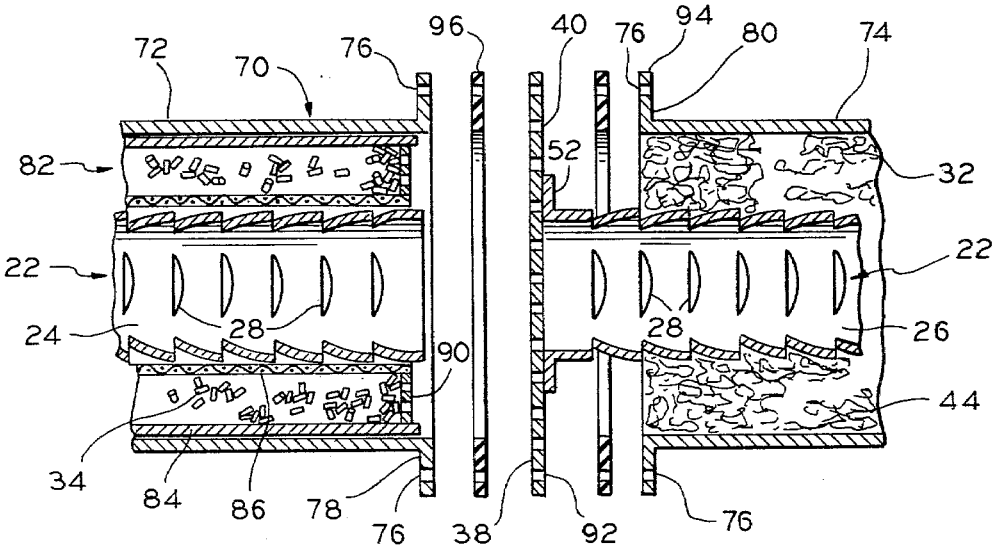
FIG. 5 is a fragmentary, diametric section of a fourth embodiment of the invention wherein the casing is divided into two separable, upstream and downstream sections, wherein the upstream section contains a cartridge substantially filled with catalyst cartridges.
Figure 6:
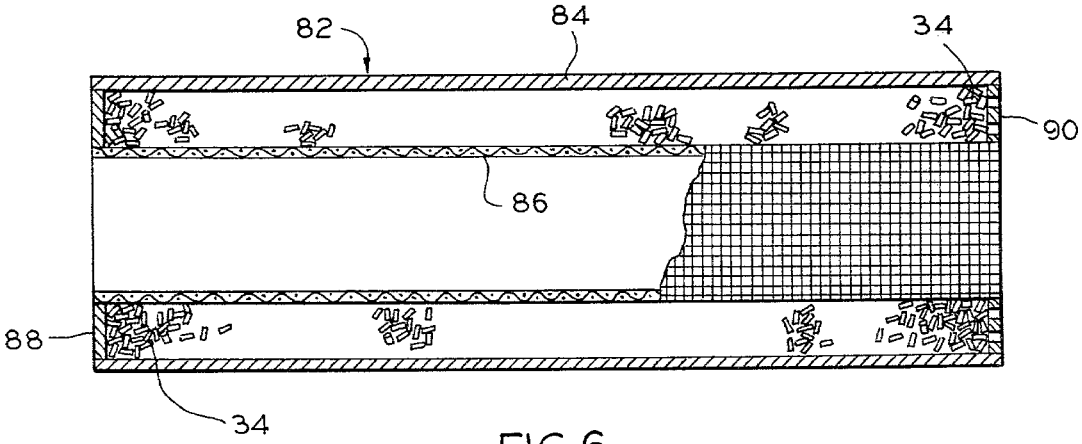
FIG. 6 is a transverse section of the catalyst-filled cartridge of FIG. 5.

The embodiment of FIGS. 5 and 6 is similar in most respects to the embodiments of FIGS. 1 and 2, and may or may not use the larger gas passage feature shown in FIG. 4. The embodiment of FIG. 5 differs in two respects from the earlier described embodiments. First, the casing 70 is divided into separable, axially aligned sections, the upstream section 72 and the downstream section 74. These sections are coupled together by bolts which extend through the bolt holes 76 in the respective flanges 78 and 80. The annular space about the upstream part 24 of the tubular core 22 is substantially filled with a tubular cartridge 82, which is replaceable by simply uncoupling the two sections 72,74 of the casing, turning or pushing aside one of the two sections, removing the old cartridge 82, and inserting a new cartridge.

The outer wall 84 of the tubular cartridge is solid, i.e., unperforated, while the inner tubular wall 86 is gas permeable, e.g., a cylindrical wall with small perforations, a metal screen or the like. The cartridge is filled with small particles 34 of the catalyst. The upstream wall of the cartridge is a solid ring wall 88 while the downstream wall of the cartridge is a gas permeable ring wall 90. The two gas permeable walls of the cartridge allow exhaust gases to flow into and through the annular body of catalyst particles 34 within the cartridge from the upstream section 24 of the tubular core 22. The bulk of these gases then flow through the downstream, ring wall 90, and through the passages 40 in the peripheral portion of the transverse wall 38. Such gases then flow in a manner similar to the flow described in the embodiment of FIG. 1.

In the embodiment of FIG. 5 the transverse wall 38 preferably is welded to the ring flange 52 of the downstream part 26 of the tubular core. The transverse wall 38 has bolt holes 92 to accommodate the aforesaid bolts inserted through the bolt holes 76. The same is true for the optional ring gaskets 94 and 96 which may be inserted between the transverse wall 38 and the respective flanges 78,80.

The annular part of the transverse wall 38 is essential only when the body of catalyst particles are loose particles not in cartridge. The transverse wall 38 may be omitted completely when the catalyst cartridge is used. The catalyst particles in most cases provide the necessary back pressure to flow of exhaust gases through the annular space of purifier. The perforate downstream end wall 90 of the cartridge retains the catalyst particles. Here, only the ring flange 52 on the core or a ring flange on the inner side of the upstream end of the section 74 is needed to keep the cartridge in place. If desired, the central part of the transverse wall between core segments 24 and 26 may be retained—the annular part of the wall 38 being omitted in this instance.

On the other hand, since the perforated transverse wall 38 in part functions as a heat shield to keep the upstream, catalyst-containing section hot enough for the catalyst to function efficiently, the annular space of the disc wall 38 may be imperforate, while the central part of the disc wall is perforate—preferably having, as shown in FIG. 4, at least one larger hole 66. In this arrangement, the hot exhaust gases pass into and out of the loose or cartridged body of catalyst particles through the apertures (louvered openings 28) in the upstream part 24 of the tubular core. The gases then pass through the holes 60,66 in the center part of the transverse wall 38 and through the sound-muffling downstream core part 26.

Thus, the present invention provides two types of exhaust gas purifiers, ones with a monolithic casing (FIGS. 1–4) and ones with a two section casing capable of being opened to replace the catalyst (FIG. 5). The purifiers with the monolithic casing are usually replaced with another like purifier with fresh catalyst. The replaced purifier is either thrown away or its casing can be opened to retrieve the spent catalyst, which can later be regenerated.

On the other hand, the purifier of FIG. 5 can remain in the exhaust system of the automobile. The casing is opened and the downstream section is pushed aside or rotated on one loosened, remaining bolt so that the spent catalyst can be removed, the spent catalyst is removed from the upstream section, fresh catalyst is installed in the upper section, and the two sections of the casing are reunited. Generally, and preferably, the aforedescribed type of catalyst cartridges are used. However, it is possible to use in the embodiment of FIG. 5 a body of catalyst composed of loose particles of small catalyst beads, cylindrical pellets, etc., or a honeycomb body or bodies which are monolithic or monoletic. Replacement of the spent, small catalyst particles would require removal of the casing from the exhaust system of the automobile in order to pour into and substantially fill the upstream, annular space in the upstream section of the purifier while it is substantially vertical.

Tests with the subject purifiers in automotive exhaust systems indicate excellent results in reduction of hydrocarbon and carbon monoxide emission. At a City of Chicago official vehicle emission test site, the exhaust emission from a 1979 Chevrolet with an 8 cylinder engine was tested. The original equipment catalytic converter was replaced with an exhaust gas purifier of the type shown in FIG. 1. The catalyst was a commercial palladium-platinum catalyst in the form of small particles.

The test results were

| | Legal max | Idle Value | Idle RPM | High Speed Value | High Speed RPM |
|---|---|---|---|---|---|
| Hydrocarbons, ppm. | 250 | 72 | 682 | 70 | 2343 |
| Carbon monoxide, percent | 1.5 | 0.2 | 682 | 0.3 | 2343 |

It will be appreciated from the foregoing that the invention herein can take many forms other than the preferred forms shown in the drawings and that the invention as herein claimed is not limited to the illustrated embodiments.

I claim:

1. An automotive exhaust gas purifier which comprises a tubular core means for conveying hot exhaust gases from an entrant opening to an exit opening in a casing surrounding said core means and defining the outer side of an annular space between said core means and said casing, a plurality of small passages in said core means for passage of exhaust gases between said core means and said casing, a transverse wall dividing said annular space into an upstream segment and a downstream segment, a gas permeable body of catalyst for purifying said hot exhaust gases positioned in said upstream segment of said annular space and surrounding said small passages within said upstream segment, and said transverse wall having a plurality of apertures therein and through which said exhaust gases can flow from said annular space of said upstream segment to the downstream segment, said tubular core being divided into an upstream part extending from the gas entrant end of said casing to one side of said transverse wall and a downstream part extending from the opposite side of said transverse wall to the gas exit end of said casing, said upstream and downstream parts being divided by a part of said transverse wall, which part also has a plurality of small passages for passage of part of the exhaust gases through from said upstream part directly into said downstream part.

2. A gas purifier as claimed in claim 1 wherein said downstream segment of said annular space is substantially filled with fiber glass.

3. A gas purifier as claimed in claim 1 wherein said small passages are transversely louvered openings in said tubular core means.

4. A gas purifier as claimed in claim 1 wherein said small passages are transversely louvered openings in said core means and are arranged in a plurality of longitudinal columns on said core means.

5. A gas purifier as claimed in claim 1, wherein said transverse wall also has a circular gas passage having a diameter in the order of $\frac{1}{4}$ inch to $\frac{3}{4}$ inch, the size of which passage is larger than the size of the individual small passages in said wall.

6. A gas purifier as claimed in claim 1, wherein said casing is divided transversely into an upstream section and a downstream section, said tubular core means being divided into an upstream part inside said upstream section and a downstream part inside said downstream section, means releasably coupling said two sections together, a removable cartridge seated in said upstream section about said upstream part of said tubular core means in the annular space between said upstream part of said tubular core means and the upstream section of said casing, said cartridge having annular inner and outer walls with an end wall between the respective upstream and downstream ends of the annular inner and outer walls, said cartridge containing said body of catalyst, the annular inner wall of said cartridge being permeable to flow of exhaust gases into said body of catalyst in said cartridge from said small passages in said upstream part of said core means, and the downstream end wall of said cartridge facing said transverse wall also being permeable to flow of exhaust gases out of said cartridge.

7. A gas purifier as claimed in claim 6, wherein said transverse wall is fixedly attached to the downstream part of said tubular core means.

8. A gas purifier as claimed in claim 6 wherein said small passages are transversely louvered openings in said tubular core means.

9. A gas purifier is claimed in claim 6 wherein said downstream segment of said annular space is substantially filled with fiber glass.

10. A gas purifier as claimed in claim 1, wherein said casing is divided transversely into an upstream section and a downstream section on opposite sides of said transverse wall, said body of catalyst in said upstream segment being in said upstream section, and means releasably coupling said sections together.

11. An automotive exhaust gas purifier which comprises a tubular core means for conveying hot exhaust gases from an entrant opening to an exit opening in a casing surrounding said core means and defining the outer side of an annular space between said core means and said casing, a plurality of small passages in said core means for passage of exhaust gases between said core means and said casing, said casing being divided transversely into an upstream section and a downstream section, said tubular core means being divided into an upstream part inside said upstream section and a downstream part inside said downstream section, means releasably coupling said two sections together, a removable cartridge seated in said upstream section about said upstream part of said tubular core means in the annular space between said upstream part of said tubular core means and the upstream section of said casing, said cartridge having annular inner and outer walls with an end wall between the respective upstream and downstream ends of the annular inner and outer walls, said cartridge containing a gas permeable body of catalyst for purifying hot exhaust gases, the annular inner wall of said cartridge being permeable to flow of exhaust gases into said body of catalyst in said cartridge from said small passages in said upstream part of said means, and the downstream end wall of said cartridge facing said downstream section also being permeable to flow of exhaust gases out of said cartridge, said gas purifier including a transverse wall in said casing which divides said casing into said upstream section and and said downstream section, wherein the annular portion of said transverse wall coextensive with said annular space is perforated by many small holes for passage therethrough of exhaust gas leaving the exit of said cartridge, and said transverse wall also divides said tubular core means into said upstream part and said downstream part, and the center portion of said transverse wall is perforated by small holes for passage therethrough of exhaust gases.

* * * * *